US009546493B2

(12) United States Patent
Chen et al.

(10) Patent No.: US 9,546,493 B2
(45) Date of Patent: Jan. 17, 2017

(54) PORTABLE POOL CLEANER

(71) Applicant: POOLSTAR CANADA LIMITED, Stratford (CA)

(72) Inventors: Liang Chen, Stratford (CA); Frédéric Abraham, Barcelona (ES)

(73) Assignee: POOLSTAR CANADA LIMITED, Stratford (CA)

( * ) Notice: Subject to any disclaimer, the term of this patent is extended or adjusted under 35 U.S.C. 154(b) by 134 days.

(21) Appl. No.: 14/449,367

(22) Filed: Aug. 1, 2014

(65) Prior Publication Data

US 2016/0032604 A1 Feb. 4, 2016

(51) Int. Cl.
*E04H 4/16* (2006.01)

(52) U.S. Cl.
CPC ..... *E04H 4/1636* (2013.01)

(58) Field of Classification Search
CPC ..... E04H 4/1636
USPC ..... 210/167.1, 167.16, 167.17, 416.1, 416.2; 15/1.7
See application file for complete search history.

(56) References Cited

U.S. PATENT DOCUMENTS 3,803,658 A * 4/1974 Raubenheimer ..... E04H 4/1663 15/1.7
4,168,557 A * 9/1979 Rasch ..... E04H 4/1654 15/1.7
4,651,376 A 3/1987 Ford
5,337,434 A * 8/1994 Erlich ..... E04H 4/1654 15/1.7
6,412,133 B1 * 7/2002 Erlich ..... E04H 4/1654 15/1.7
6,797,157 B2 9/2004 Erlich
6,939,460 B2 9/2005 Erlich
7,060,182 B2 6/2006 Erlich et al.
7,178,188 B1 2/2007 Jaakola
D556,396 S 11/2007 Mah et al.
7,520,015 B1 4/2009 Ajello
(Continued)

FOREIGN PATENT DOCUMENTS

AU 2014243799 A1 10/2014
AU 2014248820 A1 10/2014
(Continued)

OTHER PUBLICATIONS

European Patent Office, Extended European Search Report, EP Application No. 14181520.9, mailed on Mar. 25, 2015, 7 pages.

*Primary Examiner* — Fred Prince
(74) *Attorney, Agent, or Firm* — Bereskin & Parr LLP/S.E.N.C.R.L., s.r.l.

(57) ABSTRACT

The present portable pool cleaner is provided with an improved annular impeller, which facilitates the possible use of a fore receptacle without a filter bag, operating as an eddy trap for large debris, and also facilitates having an aft receptacle incorporating a filter bag or direct connection to in pool filtration systems. The annual impeller is able to effectively limit object size passing to the next stage, within impeding or striking objections passing through the inside gap in the annular impeller. The impeller duct/annular shape, with internal spiral blades, forms a through hole for the light sewage to more easily pass, while heavier particles in the sewage are trapped. The optional fore and aft receptacles may be detachable to facilitate cleaning, replacement and access to the impeller for cleaning or replacement. The handheld design facilitates underwater use.

15 Claims, 5 Drawing Sheets

(56) References Cited

U.S. PATENT DOCUMENTS

| | | | | |
|---|---|---|---|---|
| 7,636,975 | B2 | 12/2009 | Mah et al. | |
| 8,281,441 | B1 | 10/2012 | Erlich et al. | |
| D684,738 | S | 6/2013 | Richiuso et al. | |
| D685,542 | S | 7/2013 | Erlich et al. | |
| 8,627,533 | B2 | 1/2014 | Pichon et al. | |
| D720,101 | S | 12/2014 | Erlich et al. | |
| D721,460 | S | 1/2015 | Hanan et al. | |
| D728,873 | S | 5/2015 | Renaud et al. | |
| D733,374 | S | 6/2015 | Richiuso et al. | |
| 9,091,092 | B1 | 7/2015 | Hui et al. | |
| D746,522 | S | 12/2015 | Erlich et al. | |
| D747,573 | S | 1/2016 | Richiuso et al. | |
| D747,574 | S | 1/2016 | Richiuso et al. | |
| 2002/0104790 | A1* | 8/2002 | Lincke | B01D 29/27 210/167.16 |
| 2003/0101523 | A1 | 6/2003 | Lepley, Jr. | |
| 2006/0032539 | A1 | 2/2006 | Meijden et al. | |
| 2006/0032801 | A1 | 2/2006 | Reid | |
| 2009/0136363 | A1* | 5/2009 | Stiles, Jr. | F04D 29/588 417/53 |
| 2012/0216837 | A1 | 8/2012 | Kovarik et al. | |
| 2014/0076789 | A1 | 3/2014 | Shlomi-Shlomi et al. | |
| 2014/0137891 | A1 | 5/2014 | Hanan et al. | |
| 2014/0310894 | A1 | 10/2014 | van der Meijden et al. | |
| 2015/0047713 | A1 | 2/2015 | Acklin | |
| 2015/0050162 | A1 | 2/2015 | Acklin | |
| 2015/0128361 | A1 | 5/2015 | Erlich et al. | |
| 2015/0225974 | A1 | 8/2015 | Kovarik et al. | |
| 2015/0337555 | A1 | 11/2015 | Hui et al. | |
| 2016/0017623 | A1 | 1/2016 | Munsey | |

FOREIGN PATENT DOCUMENTS

| | | | |
|---|---|---|---|
| CA | 2002314 | C | 10/1994 |
| CN | 101363285 | B | 6/2010 |
| CN | 303143929 | S | 3/2015 |
| CN | 303151532 | S | 4/2015 |
| CN | 303329999 | S | 8/2015 |
| DE | 2529183 | C2 | 10/1984 |
| DE | 2031788 | U1 | 4/2004 |
| GB | 1565607 | A | 4/1980 |
| GB | 2153208 | B | 8/1985 |
| WO | 2009/007921 | A2 | 1/2009 |
| WO | 2016026727 | A1 | 2/2016 |
| WO | 2016034371 | A1 | 3/2016 |

* cited by examiner

PORTABLE POOL CLEANER

FIELD

The present invention relates generally to the pool cleaners for swimming pools and/or spas, and more particularly to handheld vacuum style cleaners for pools.

BACKGROUND

While modern swimming pool and/or spa facilities typically include a filtration unit containing appropriate filter media, it is often desirable to use additional devices to clean portions of the pool where solid debris, such as fine grit, silt, twigs, leaves, insects and other particulate matter accumulate notwithstanding the built in filter system.

Electric motor driven pumps for use with swimming pools and/or spas are generally known in the art, wherein a battery operated motor drives a pump or blade to pull water and impurities through a strainer, then the pump/blade and finally ejecting the liquid back into the pool.

There is a desire for an improved handheld pool vacuum cleaner in which larger items are more probably collected prior to the strainer/filter to avoid damage to the filaments in the strainer/filter.

There is a desire for an improved handheld pool vacuum cleaner with greater suction force or to process a greater volume of water in a given period of time.

There is a desire for an improved impeller for a handheld pool vacuum cleaner.

SUMMARY

A handheld pool cleaner features an input, an output, an annular impeller and a power source to drive the annular impeller to draw pool water through the pool cleaner. The annular impeller draws water through the inside of the annulus from the input to an output, and is able to allow particles of a certain diameter to pass unobstructed (without pre-filtering). Cleaning of the pool water may occur by way of an eddy trap at the input, a strainer/filter at the output, an separate in pool filtration system into which the output may eject the water or some combination of the foregoing The impeller is comprised of a cylinder featuring spiral veins about the inner surface. The spiral veins have a depth less than the full radius of the cylinder, so as to create an annular shape pulling water inside the impeller rather than about it. The passage within the annular impeller which is not traversed by the spinning veins facilitate passage of debris laden water through the impeller.

The input may be a simple opening in the device housing or may include a cleaning head having an input tube having a bypass, a fore receptacle about the bypass, and an fluid connection to the inner passage through the impeller. The output may include an aft receptacle having a strainer/filter bag assembly, or it may include a direct connection adapted to receive a hose to a built in pool filtration system.

In one example the input includes a bypass, baffles, or other indirect fluid connection with the impeller, and these bypass gaps, baffles or disconnections between the inlet and the outlet of the fore receptacle can be generally referred to as fluid flow disruptions. The fluid flow disruptions create an eddy trap in the fore receptacle, causing heavier, larger or denser debris to fall into or collect within the fore receptacle while other debris is able to pass through the impeller without pre filtering, and into the device outlet.

Incorporating an aft receptacle, such as a strainer/filter bag assembly, downstream of the impeller at the output is an optional improvement which may allow less wear and tear on filter bags as compared to device in which the filter bag is positioned upstream of the impeller. Debris which is too large to pass through the through passage of the impeller is impeded and does not tear the filter, whereas, due to the shape of the impeller, smaller or longer objects are unlikely to contact the blades as would be the case with externally protruding blades in the impeller.

The motor rotates to drive the high speed rotation of the impeller, and gears may be used to ensure the operating frequency of the impeller is within an appropriate operating range as compared to the actual frequency of the motor. The centrifugal and displacement forces generated in the high-speed rotation of the impeller creates suction to draw sewage water into the input, through the eddy trap/fore receptacle (if provided), through the annular impeller, and out the output which could be an aft receptacle, a bypass valve or a direct connection to the built in pool filtration system. Heavier debris tends to accumulate in the eddy trap (if provided), so as to be less likely to damage the filaments in the filter bag or impact the impeller.

The input from the cleaning head through the fore receptacle to the impeller need not be in perfect fluid communication with the impeller. Gaps or open slates around the primary intake nozzle temporarily agitate the flow and redirect larger objects from the impeller, which may creating an improved eddy trap for large debris in a handheld pool cleaner. The inlet to the fore receptacle may be directed towards a baffle, which the outlet from the fore receptacle may be positioned at a different angle so as to improve the eddy trap effect.

A combination of an eddy trap upstream of the impeller and a strainer/filter bag assembly downstream of the annular impeller may serve to protect the strainer/filter bag assembly from damage potentially caused by larger or heavy debris which is caught in the eddy trap. A cylinder/annular shaped impeller featuring veins on the inner surface of cylinder (rather than radial from the centre) may improve flow through the device as compared to prior art devices.

Preferably, the motor and power supply for the device is sealed from the impeller and fore and aft receptacle, so as to prevent water from corroding or damaging the motor and power supply. A small engine may also be used to drive the impeller, without departing from the inventive aspects related to the locations of the various debris receptacles, impeller and filter.

The impeller duct shape, with internal spiral blades, provides additional benefit in that debris is less likely to strict the blades than in traditional axle driven designs.

In one example, the body of the device comprises an outer cover and an inner cover, the outer cover and inner cover defining an outer cavity which may be referred to as the motor cavity wherein a drive shaft for the motor and gears are to be located, and an inner cover defining an inner cavity which may be referred to as the suction cavity wherein the impeller rotates.

In one example, the input detachably attaches to the body in front of the impeller. Where the input includes a fore receptacle, an output of the fore receptacle is in fluid communication with the impeller and the inlet tube of the fore receptacle is available to draw fluids into the device, but otherwise the fore receptacle has a water tight seal to the body of the device. In such a pool cleaner, the fore receptacle can be fully removed for cleaning and to empty collected debris. In another example of the pool cleaner, the input may include a fore receptacle which is fully attached to the device, but contains a door which may be opened to allow debris to be cleared from the eddy trap in the fore receptacle.

In another pool cleaner, the output comprises an aft receptacle with a strainer or cage within a removable filter bag, which strainer/filter bag assembly detachably attaches to the body in back of the impeller. An input of the aft receptacle is in fluid communication with the impeller and outlets from the aft receptacle and the filter are available to permit discharge of water from the device. In such an embodiment, the aft receptacle and filter can be fully removed for cleaning and to empty collected debris and replacement of the filter bag (if necessary). In another embodiment, the aft receptacle is attached, but contains a door which may be opened to allow the filter to be removed and debris to be cleared from the filter before replacing it in the aft receptacle. A bypass valve may be provided should the aft receptacle fill or all outputs become clogged, and an attachment to permit direct connection to an external or built in pool filtration system may be provided

BRIEF DESCRIPTION OF THE DRAWINGS

FIG. 3 shows an expanded cross sectional view of body of the device of

FIG. 1.

DETAILED DESCRIPTION

Certain embodiments of the present invention will now be described in greater detail with reference to the accompanying drawings.

Figure 1:
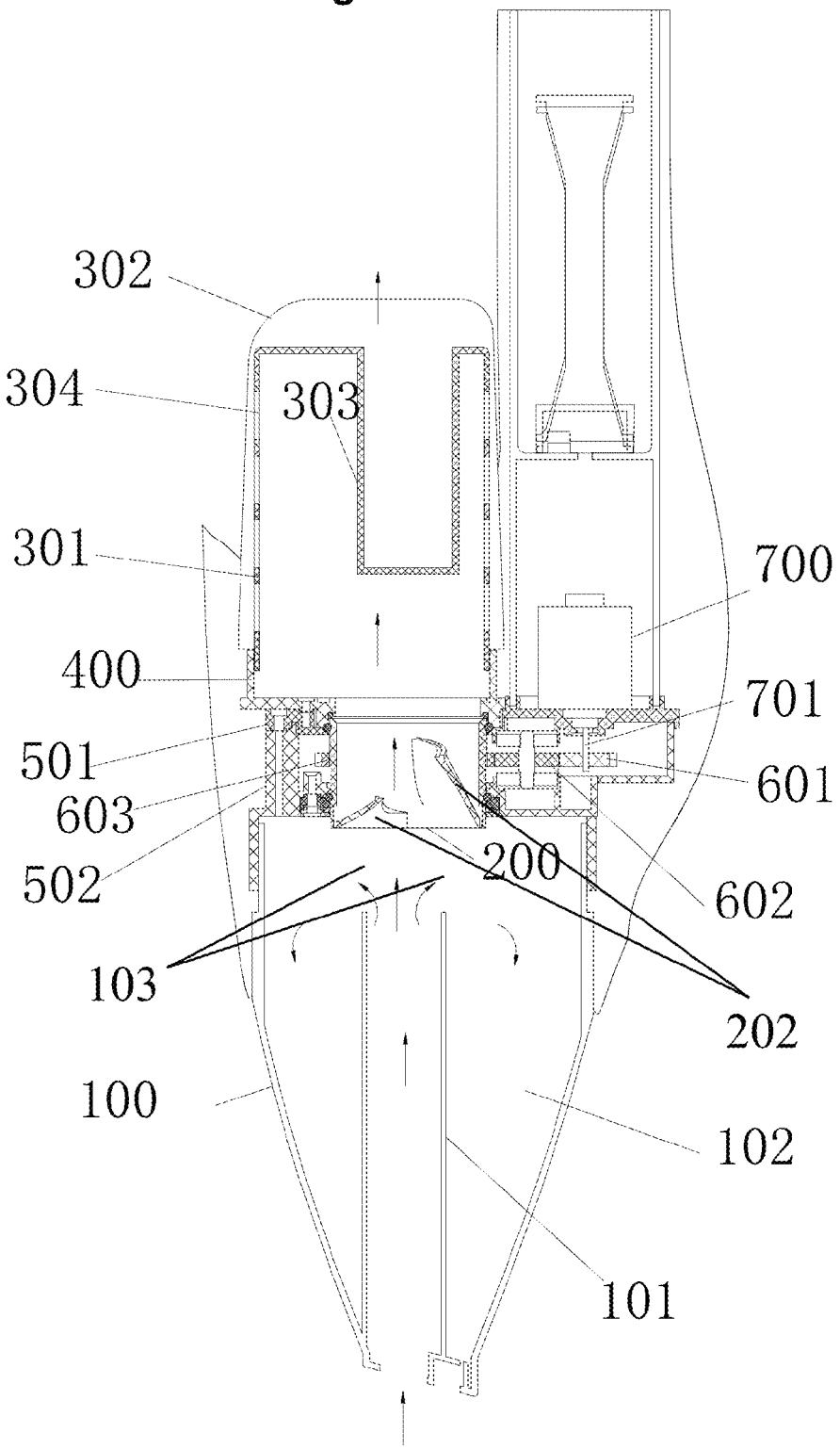
FIG. 1 shows a cross sectional view of the operating portion of a portable pool cleaner in the longitudinal direction of flow.
Figure 2:
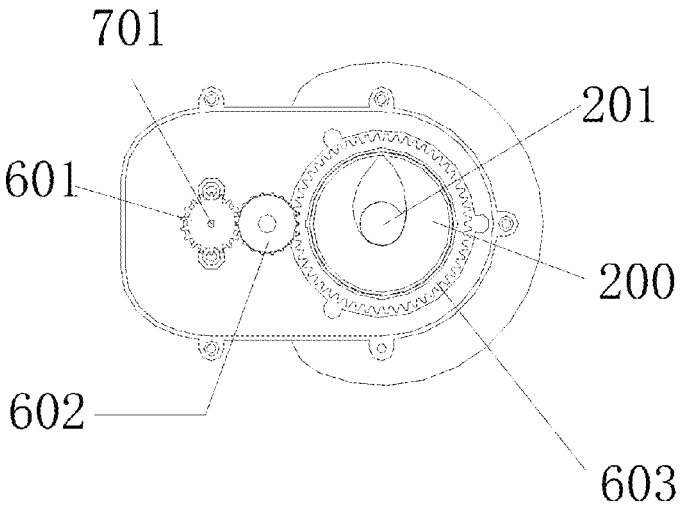
FIG. 2 shows a cross section view of the motor chamber and suction chamber of the portable pool cleaner perpendicular to the direction of flow.

As shown in FIG. 1, the pool cleaner 100 has in input tube 101 towards an impeller cylinder 200, with one or more gaps or slots 103 interrupting fluid communication between the input tube 101 and the impeller 200, so as to permit the sewage/debris water to eddy within the fore receptacle 102. As shown in FIG. 1 and FIG. 2, an electric motor 700 drives axle 701 and gears 601, 602 and 603 to turn the impeller 200 within the sealed suction chamber formed (in this embodiment) between upper cover 501 and lower cover 502. The direction of sewage/debris water flow is shown by the arrows. Although the drive means shown are an electric motor 700, axle 701 and gears 601, 602 and 603; other means to drive the annular rotor may be known and useful, including electric rotor designs (in which the annual impeller is the rotor) or other gearing systems powered by engines instead of motors; etc.

The sewage/debris water leaving the impeller 200 flows into aft receptacle 303 about which the filter bag 302 is to be fitted. Aft receptacle 303 is plastic cage portions 301 defining openings 304 to strain larger material from the water before it exits into the filter bag 302 and is returned to the pool or spa. The aft receptacle 303 detachably attaches to the body of the device at output cap 400 by means of a snap, threaded or other connection.

FIG. 2 also shows the through bore 201 notionally formed between the veins (202 of in FIG. 1) of spinning impeller 200, as a more direct path between the fore receptacle and aft receptacle.

Figure 3:
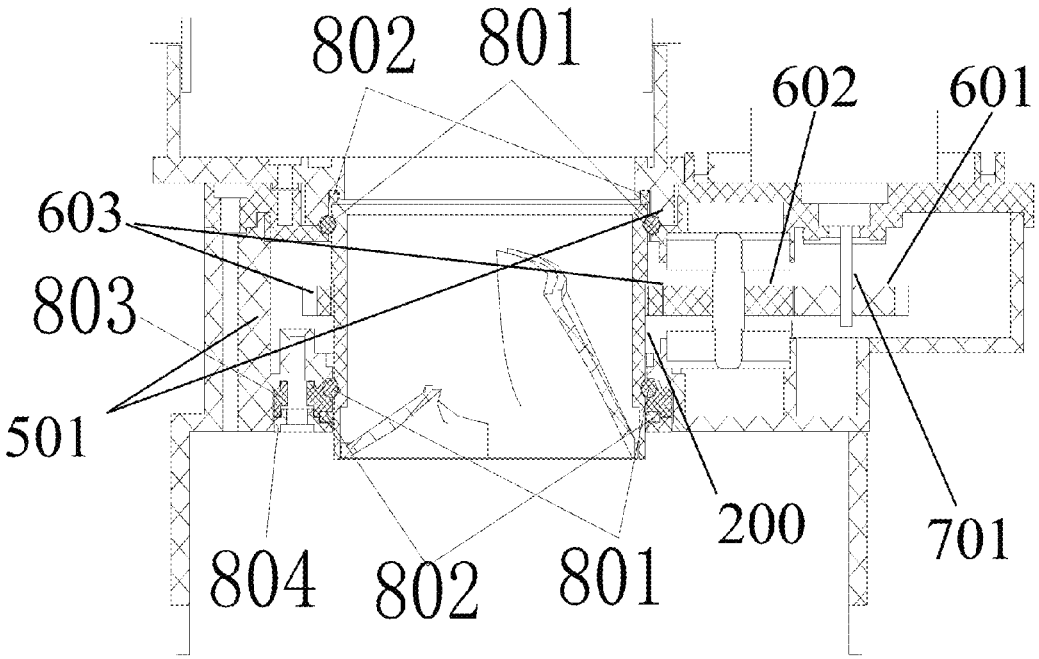

As shown in FIG. 3, auxiliary support may be provided to the impeller by a wheel support lower support members 803 and 804, to reduce friction and align the impeller. The contact position of the impeller 200 and the inner cover 501, the impeller 200 and the lower cover 502 and the contact position of the support member 803 are each provided with two rows of peripheral recesses shaped, concave embedded ball grooves 801, which define the axial movement of the impeller 200 and which can serve to reduce the frictional force. In other embodiments, the recess can be embedded in the bearing. Various low friction seals 802 prevent sewage/debris water from flowing about the impeller 200 into the cavity where gear 603 on the impeller is driven by step-down gears 602 and 601 attached to the drive axle 701.

Figure 4:
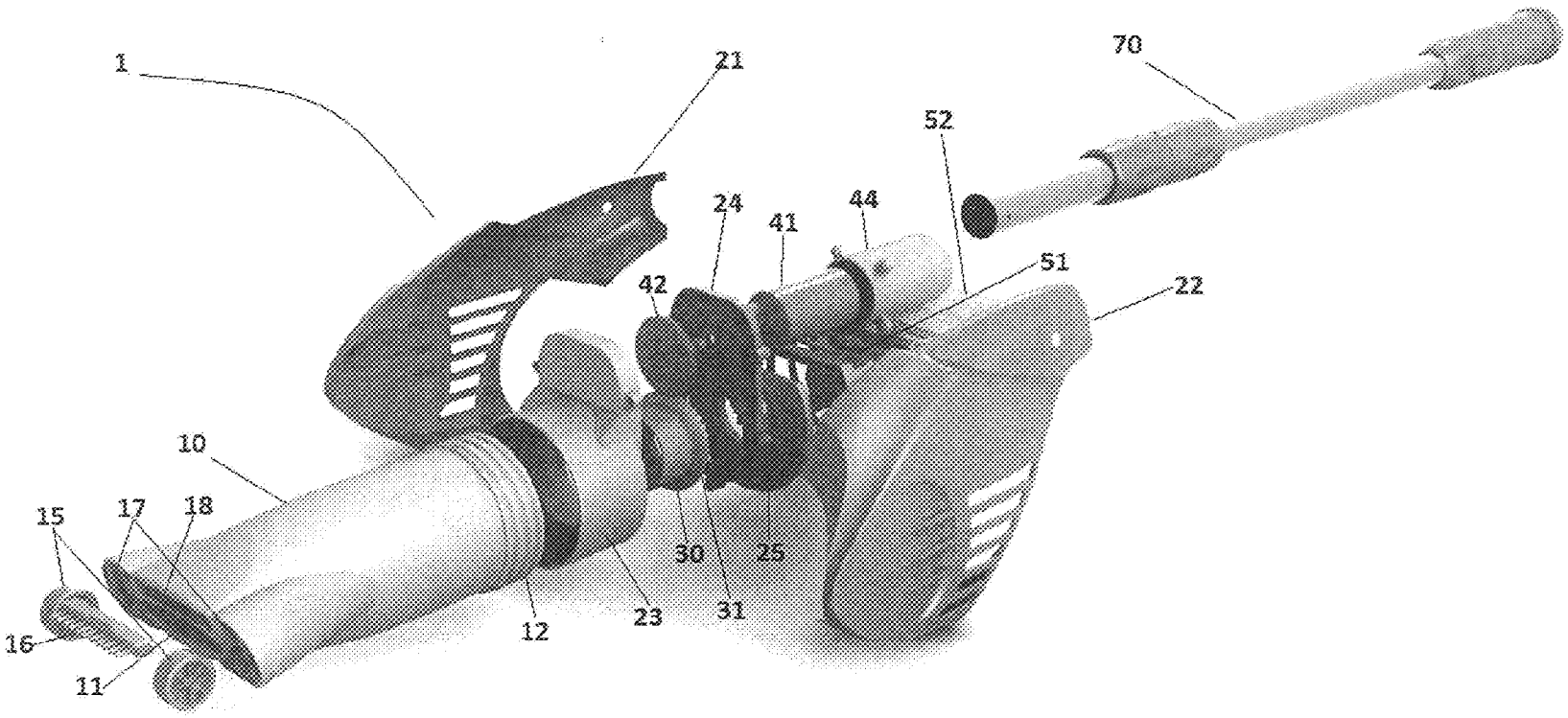
FIG. 4 shows an exploded perspective view of another embodiment of a portable pool cleaner from the front.
Figure 5:
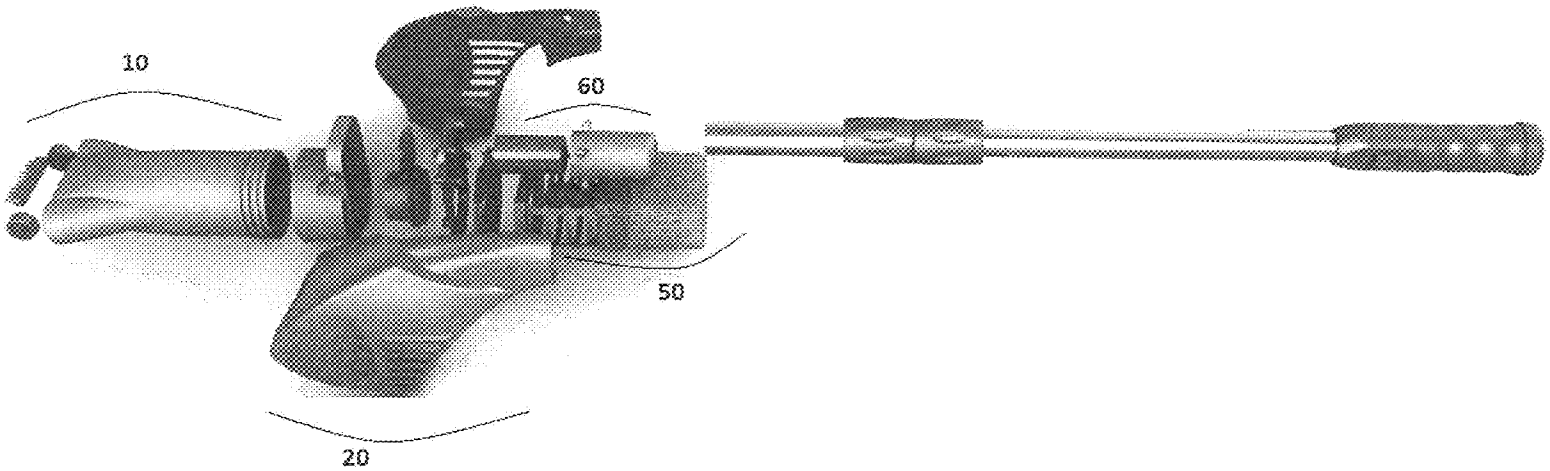
FIG. 5 shows a different exploded perspective view of the embodiment of a portable pool cleaner shown in FIG. 4 from the side.

FIG. 4 and FIG. 5 show another embodiment of the pool cleaner 1. The suction head 10 is provided with an input path 11 and threaded grooves for detachable attachment to the rest of the device. Optional rollers 15 may be fitted or clipped into roller slots 17 and optional brush head 16 may be fitted or clipped into brush slot 18. The main body 20 (as indicated in FIG. 5) is comprised for a right outer cover 21, left outer cover 22, front cap 23, intermediate support 24 and end cap 25. The right outer cover 21 and left outer cover 22 notionally define an outer cover. The front cap 23, intermediate support 24 and end cap 25 notionally define an inner cover, and the impeller 30 fits into a impeller guide [not labeled] within the inner cover. Impeller gear 31 about the impeller 30 is accessible within a gear cavity created between the outer cover and the inner cover and the intermediate support 24. The intermediate support and the motor cover 44, create a motor cavity for the motor 41 which drives drive gear 42. Drive gear 42 drives impeller gear 31 and thereby drives the impeller 30.

Waste water pulled through the impeller 30 is expelled into a aft receptacle 50 (as indicated in FIG. 5) comprising a strainer 51 covered by a filter bag 52. The combination of the eddy trap in the fore receptacle 10, the size of the through passage in the impeller 30 and the size of the slots in the strainer cage 51 protect the filter bag 52, and may allow a greater rate of water volume to pass through the device than competing front filter vacuum cleaners.

Figure 6:
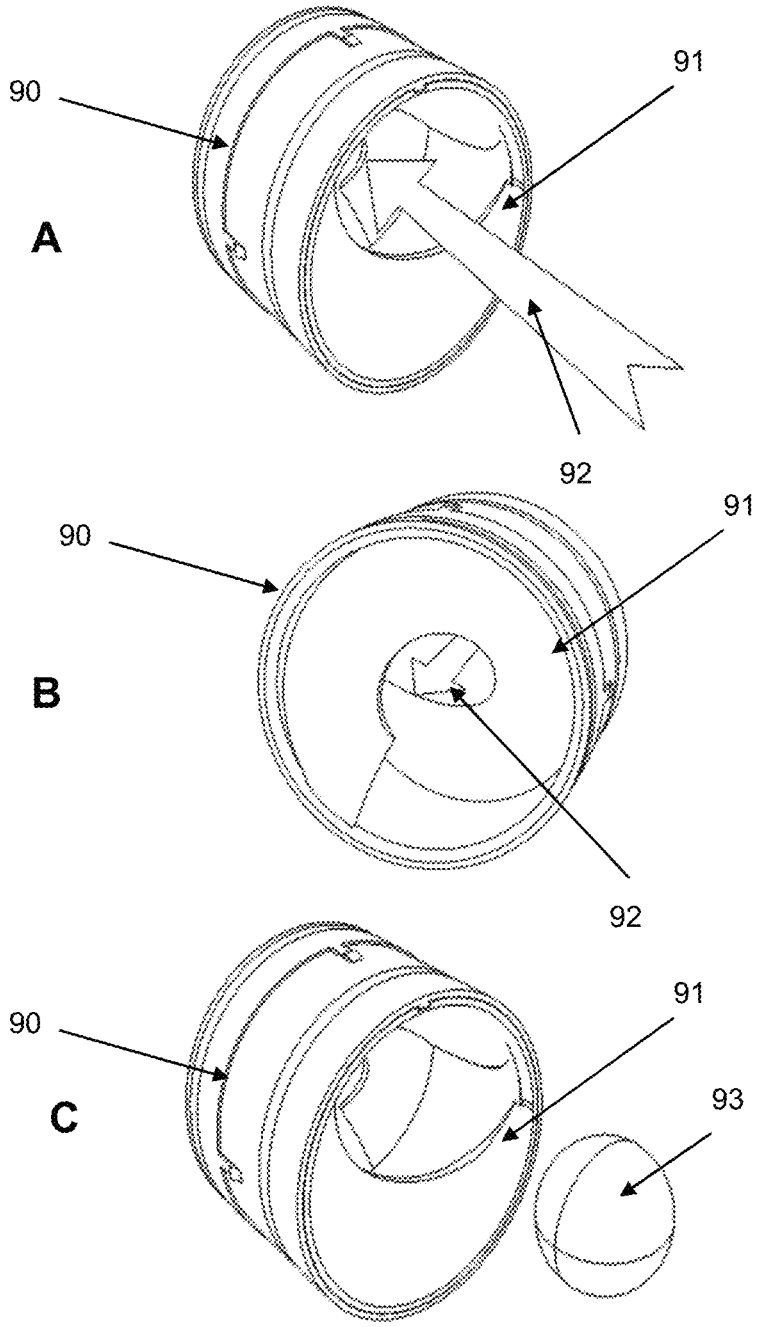
FIG. 6A, FIG. 6B and FIG. 6C shows perspective views of one example of the annular impeller from the front, the back and with a size of debris which is capable of passing straight through the inside passage of such impeller without contacting the blade(s), respectively.

FIG. 6 shows three perspective views (A, B and C) an annular impeller 90, having spiral inner veins or blades 91. A through passage 92 (shown in FIG. 6A and FIG. 6B) allows passage of a particle 93 (shown in FIG. 6C) up to a maximum diameter of less than a known size from passing. Where a helical blade form is used, it allows objects to pass between the blade and the inner wall of the impeller.

In prototyping, an impeller having total diameter of approximately 49 mm has one helical internally disposed blade which protrudes to within approximately 7 mm of the centre axis of the impeller (total diameter of the through bore when seen from the front is approximately 14 mm). Due to the helical shape of the blade, the impeller allows unobstructed passage of hard rubbish with a maximum diameter of approximately 2 cm, twigs smaller than approximately 10 cm by 0.5 cm, and leaves or flower heads smaller than approximately 20 cm by 8 cm or 15 cm by 15 cm. As tested, with the impeller operating at speeds of about 1000 r/min, through put of approximately 37 liters per minute was possible.

Larger impellers, and veins of larger or smaller relative size may be used, within the scope of handheld pool cleaners, without departing from the purposes herein disclosed.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

The invention claimed is:

1. A portable pool cleaner comprising:

a. a pool water input, b. a cleaner output, and c. an annular impeller in fluid communication with the pool water input on an upstream side of the annular impeller to permit fluid communication from the pool water input through the annular impeller to the cleaner output on a downstream side of the annular impeller, the annular impeller being rotatable relative to the pool water input and the cleaner output, d. wherein the annular impeller comprises a cylinder that defines a continuous path through at least the center of the cylinder that permits the fluid communication through the annular impeller, the cylinder having one or more inwardly disposed blades adapted to create suction from the upstream side of the annular impeller to the downstream side of the annular impeller when the annular impeller is rotated.

2. The portable pool cleaner of claim 1 wherein the pool water input is a cleaning head comprising an inlet in fluid communication with a fore receptacle and a fore receptacle outlet to permit fluid communication from the inlet through the fore receptacle to the fore receptacle outlet, wherein the fore receptacle comprises fluid flow disruptions between the inlet and the fore receptacle outlet, and the fluid flow disruptions create an eddy trap to collect pool water debris on the upstream side of the annular impeller while fluid flows through the fore receptacle outlet when the annular impeller is rotated.

3. The portable pool cleaner of claim 2 wherein the input is detachable from the portable pool cleaner.

4. The portable pool cleaner of claim 1 wherein the cleaner output is an aft receptacle comprising an aft receptacle inlet in tight fluid communication with the annular impeller on the downstream side of the annular impeller, a plurality of aft receptacle outputs, and a filter outside the aft receptacle outputs.

5. The portable pool cleaner of claim 4 wherein the cleaner output is detachable from the portable pool cleaner.

6. The portable pool cleaner of claim 1 wherein the cleaner output comprises a connecting member for receiving a hose connection for in pool filtration systems.

7. The portable pool cleaner of claim 1 wherein the one or more inwardly disposed blades is a single helical shaped blade.

8. A portable pool cleaner cormprising:

a. a fore receptacle comprising a pool water inlet and a fore receptacle outlet with a bypass gap between the pool water inlet and the fore receptacle outlet;

b. an aft receptacle comprising an aft receptacle inlet into a strainer adapted to be covered by a filter bag; and c. an impeller in tight fluid communication with the fore receptacle outlet and the aft receptacle inlet.

9. The portable pool cleaner of claim 8 further comprising drive means to rotate the impeller and thereby pull pool water through the pool water inlet, into the fore receptacle, through the fore receptacle outlet, through the impeller and push water through the aft receptacle inlet into the strainer.

10. The portable pool cleaner of claim 9 wherein the bypass gap creates an eddy to trap heavier debris from the pool water within the fore receptacle.

11. The portable pool cleaner of claim 9 further comprising a main body housing the drive means, the impeller and to which the fore receptacle and aft receptacle may be detachably detached.

12. The portable pool cleaner of claim 11 further comprising a detachable handle to permit a user outside the water to manoeuvre the portable pool cleaner while it is submerged.

13. The portable pool cleaner of claim 8 wherein the impeller comprises a cylinder having an inner wall and an outer wall, with one or more spiral veins disposed on the inner wall.

14. The portable pool cleaner of claim 13 wherein the impeller further comprises an impeller gear about the outer wall for interaction with drive means.

15. A portable pool cleaner comprising:

a. a pool water input, b. a cleaner output, and c. an annular impeller in fluid communication with the pool water input on an upstream side of the annular impeller and the cleaner output on a downstream side of the annular impeller, d. wherein the annular impeller comprises a cylinder having one or more inwardly disposed blades adapted to create suction from the upstream side of the annular impeller to the downstream side of the annular impeller when the annular impeller is rotated, e. wherein the pool water input is a cleaning head comprising an inlet in fluid communication with a fore receptacle and a fore receptacle outlet, wherein fluid flow disruptions between the inlet and the fore receptacle outlet create an eddy trap to collect pool water debris on the upstream side of the annular impeller, and f. wherein the input is detachable from the portable pool cleaner.

* * * * *